United States Patent [19]

Wood

[11] 4,092,905

[45] June 6, 1978

[54] AXIAL PISTON PUMP

[75] Inventor: Robert A. R. Wood, West Vancouver, Canada

[73] Assignee: Teleflex Incorporated, Limerick, Pa.

[21] Appl. No.: 658,168

[22] Filed: Feb. 17, 1976

[51] Int. Cl.[2] ..... F01B 13/04

[52] U.S. Cl. ..... 91/499

[58] Field of Search ..... 91/486, 487, 499–507

[56] References Cited

U.S. PATENT DOCUMENTS

| | | | |
|---|---|---|---|
| 3,194,172 | 7/1965 | Schottler | 91/485 |

FOREIGN PATENT DOCUMENTS

| | | | |
|---|---|---|---|
| 912.421 | 8/1946 | France | 91/499 |
| 2,311,118 | 3/1973 | Germany | 91/499 |
| 1,265,518 | 3/1972 | United Kingdom | 91/485 |

*Primary Examiner*—William L. Freeh

*Attorney, Agent, or Firm*—McGlynn and Milton

[57] ABSTRACT

An axial piston pump assembly including a housing having first and second portions with the second portion being cup-shaped and closed by the first portion which defines a closure or cover. A cylinder barrel is rotatably supported in the housing and includes a plurality of piston cavities in which a plurality of pistons are reciprocatively supported. A cam reacts with the pistons for causing reciprocating movement of the pistons as the cylinder barrel is rotated about an axis of rotation. A spicket shaft extends from the cover portion of the housing and into a cavity in the cylindrical barrel. The spicket shaft has a thrust bearing supported at the distal end thereof. Pins are press-fitted into the cylindrical barrel to engage the thrust bearing whereby reaction forces resulting from reciprocating movement of the pistons by the cam are transmitted through the cylindrical barrel, the pins and the thrust bearing to the spicket shaft and, thus, to the cover or first portion of the housing whereby the cup-shaped portion of the housing is free of tensile loads.

12 Claims, 3 Drawing Figures

AXIAL PISTON PUMP

The subject invention relates to a pump and, specifically to an axial piston pump of the type particularly suited for use in a hydraulic steering system for controlling the movements of an outboard motor or rudder of a marine boat.

Although the pump assembly of the subject invention has uses in various environments, it is particularly well suited for use in marine steering assemblies wherein hydraulic lines extend from the steering position on the boat to a rudder or outboard engine for controlling an actuator for pivotting the rudder or outboard engine for controlling the direction of the boat. Typically, a steering wheel, or the like, is connected to a shaft of an axial piston pump whereby, upon rotation of the axial piston pump, hydraulic fluid pressure is directed from the pump to one side or the other of the actuator for steering the boat. Such a pump assembly is shown in U.S. Pat. No. 3,738,228 granted to Robert R. Harrison on June 12, 1973.

The pump assemblies of the type to which the subject invention pertains include a housing having first and second interconnected portions with a cylinder barrel supported in the housing and a plurality of pistons reciprocatively supported in a plurality of piston cavities in the cylinder barrel for reciprocating movement and a cam for reacting with the pistons for causing the reciprocating movement as either the cylinder barrel or the cam is rotated. In such a construction the cam reacts with the pistons to move the pistons between a position where the cavities in which they are disposed are at a minimum pumping volume to an intake position where the cavities are at a maximum intake volume. During the compression stroke of the pistons for creating the pumping action there is a reaction force, created because of the pressure of the fluid created by the pistons, which reacts between the pistons and the cylinder barrel forming the piston cavities.

These reactions forces are transmitted to the two housing portions which are connected together in a manner to force the housing portions apart or to place the housing portions in tension. Consequently, the housing portions must be structural members.

This problem is solved in accordance with the subject invention where in such a pump assembly there is included restraining means for transferring all of the reaction forces resulting from the reciprocating movement of the pistons by the cam means solely to one of the housing portions whereby the other housing portion may be made of a nonstructural low cost material.

In the embodiment of the invention illustrated by inventive concept is accomplished by an axial pump assembly including a housing having first and second portions with a cylinder barrel rotatably supported within the housing about a spicket shaft means with a restraining means comprising a thrust bearing and pins interconnecting the distal end of the shaft and the cylindrical barrel for transmitting the reaction forces between the pistons and the cylindrical barrel through the pins and the thrust bearing to the shaft which is, in turn, connected to the housing portion against which the cam means is supported or abuts.

Other advantages of the present invention will be readily appreciated as the same becomes better understood by reference to the following detailed description when considered in connection with the accompanying drawings wherein.

Figure 2:
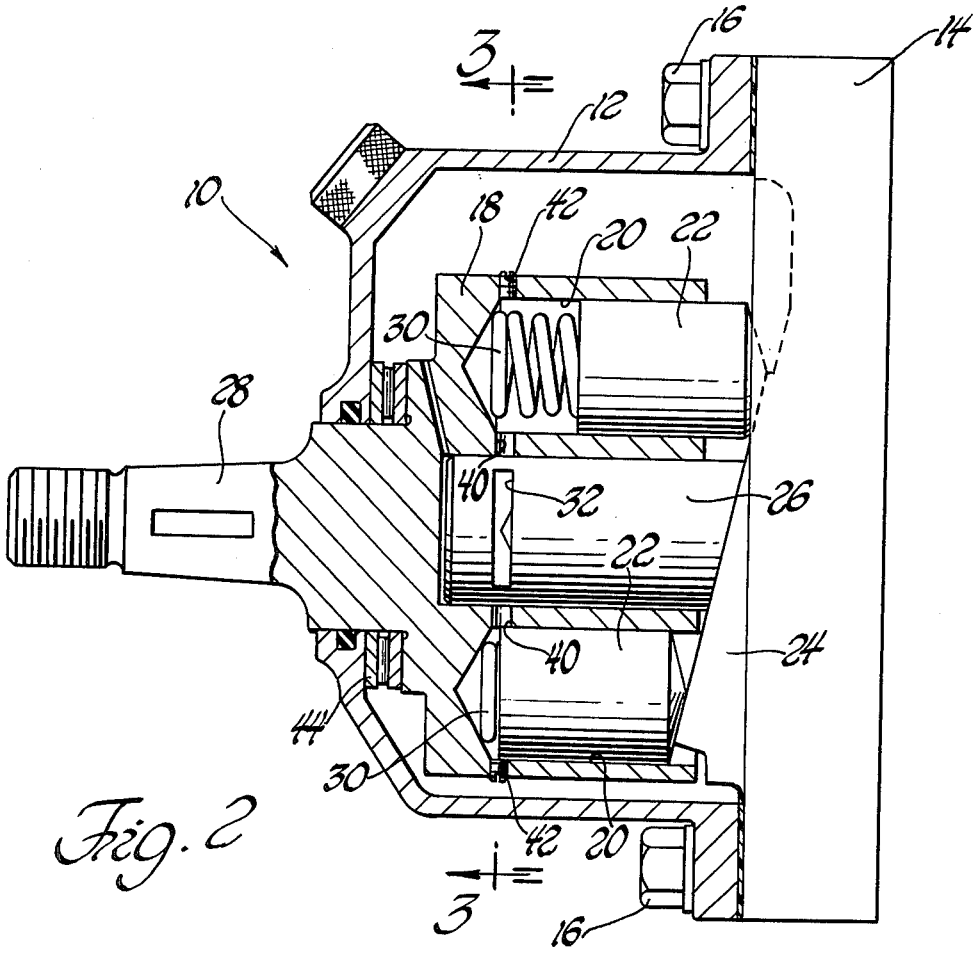
Fig. 2 PRIOR ART
FIG. 2 is a cross-sectional view showing the prior art construction.
Figure 3:
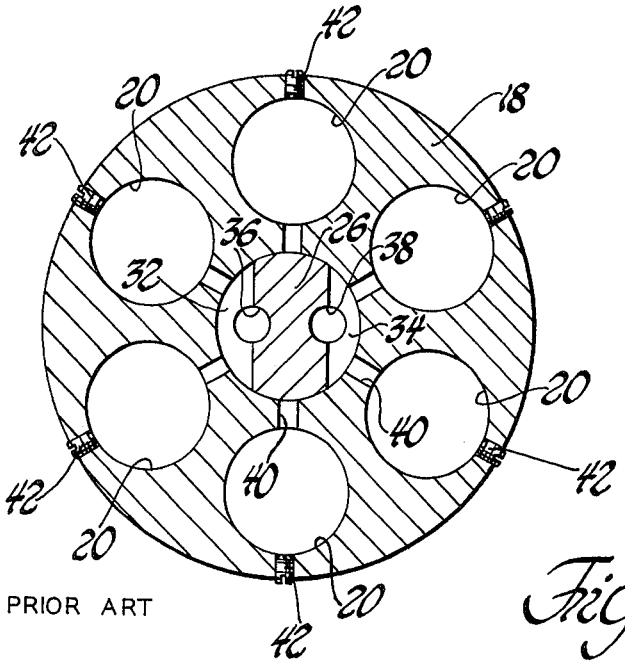
PRIOR ART Fig. 3
FIG. 3 is a cross-sectional view taken substantially along line 3—3.

Referring first to FIGS. 2 and 3, there is disclosed generally at 10 an axial piston pump assembly constructed in accordance with the prior art teachings. The axial piston pump assembly 10 includes a housing means including a first cup-shaped closing portion 12 and a second housing portion 14 defining a cover or closure plate. The first and second housing portions 12 and 14 are interconnected by bolts 16. The cup-shaped housing 12 defines a tank for hydraulic fluid and surrounds a cylinder barrel 18. The cylinder barrel 18 includes a plurality of piston cavities 20 in which are reciprocally supported a plurality of pistons 22. The cover plate or housing portion 14 supports a cam 24 which reacts with the pistons 22 for causing reciprocating movement of the pistons as the cylinder barrel 18 rotates. The cylinder barrel 18 is rotatably supported on a spicket shaft 26 which is, in turn, rigidly secured to the closure or cover plate 14. A shaft portion 28 is rotatably supported in the cup-shaped housing 12 and extends from and is integral with the cylinder barrel 18. Springs 30 are disposed in the piston cavities 20 between the ends of the pistons 22 and the ends of the piston cavities 20 for urging the pistons 22 against the cam 24.

The spicket shaft 26 includes a fluid inlet port 32 and a fluid outlet port 34. The ports 32 and 34 are in communication with the fluid passages 36 and 38 which, in turn, are in communication with fluid passages in the cover plate or closure member 14 which lead to fluid connections for the pump assembly. A fluid port 40 extends from each piston cavity 20 to the spicket shaft 26 for fluid communication with the ports 32 and 34 during rotation of the cylinder barrel 18 for directing fluid flow to and from the piston cavities 20. In order to machine and form the fluid passage or ports 40, the cylinder barrel 18 must be drilled from the exterior thereof radially inwardly through each piston cavity 20 and thereafter the exterior portion of the holes must be plugged with the threaded plugs 42.

As the cylinder barrel 18 rotates and the pistons 22 react with the cam 24 for pressurizing fluid in the piston cavities 20 a reaction force results between the pistons 22 and the cylinder barrel 18 to urge the cylinder barrel 18 to the left, as viewed in FIG. 2, against a thrust bearing 44. Such a reaction force places the cup-shaped housing portion 12 in tension along its side walls, therefore requiring that the housing portion 12 be a structural member.

Figure 1:
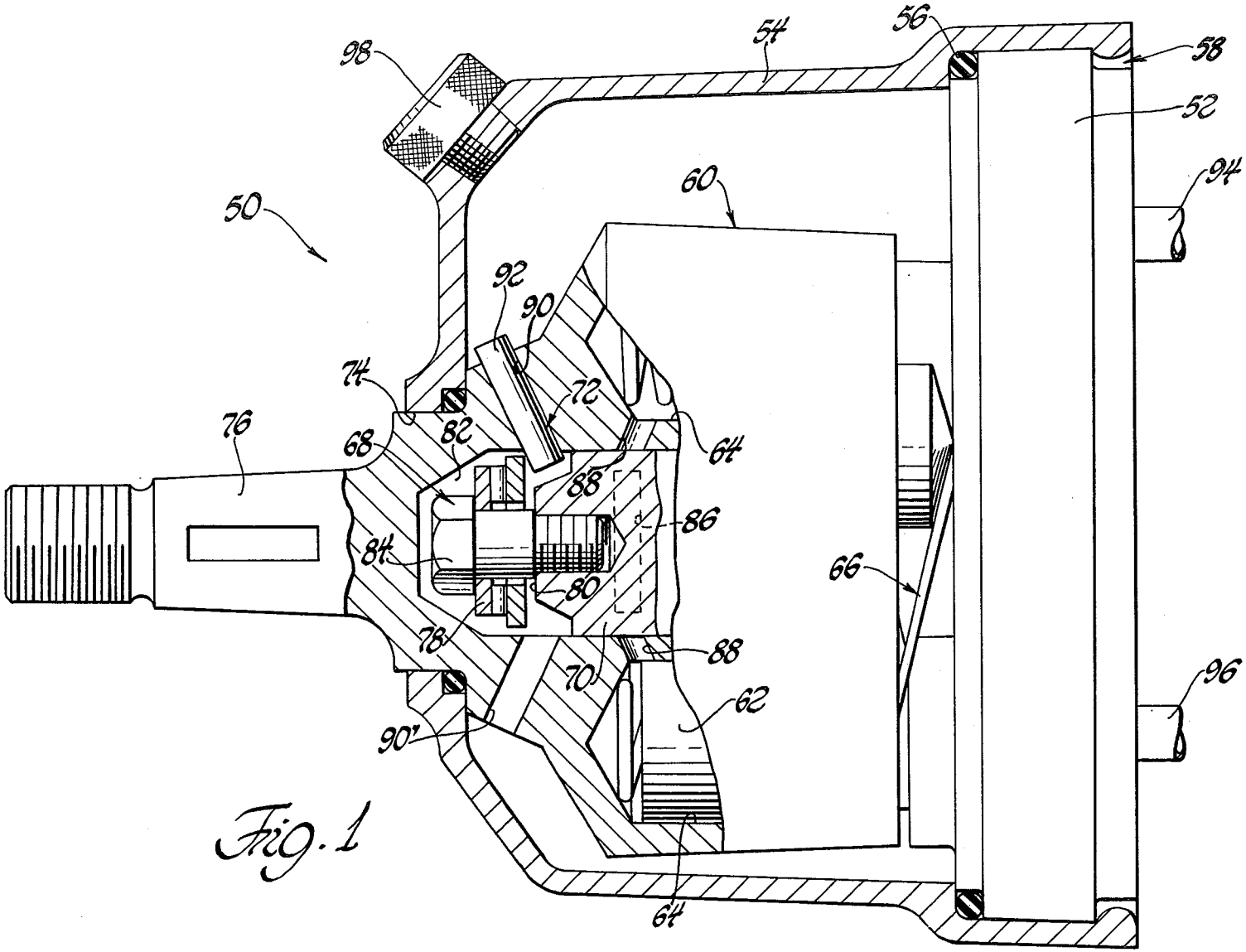
FIG. 1 is a cross-sectional view of a preferred embodiment of the subject inventive concept.

Referring now to FIG. 1, an axial piston pump assembly constructed in accordance with the instant invention is generally shown at 50. The pump assembly 50 comprises a housing means including first and second interconnected housing portions. The first housing portion is defined by a closure or cover portion 52 and the second housing portion is defined by the cup-shaped portion 54. A seal 56 is disposed between the first and second housing portions 52 and 54. The first and second housing portions 52 and 54 may be secured together in any convenient manner such as by gluing bolts, fasteners, or a snap-in ridge and groove as generally indicated at 58.

A cylinder barrel generally indicated at 60 is supported in the housing means. A plurality of pistons 62 are reciprocatively supported in a plurality of piston cavities 64 in the cylinder barrel 60 for reciprocating movement parallel to an axis of rotation. A cam means generally indicated at 66 reacts with the pistons 62 for causing the reciprocating movement thereof. The cylinder barrel 60 and the cam means 66 are supported in the housing means for rotation relative to one another about the axis of rotation for effecting the reciprocating movement of the pistons 62. Such is accomplished because the cylinder barrel 60 is rotatably supported in the housing means, as will be described more specifically hereinafter.

The assembly 50 also includes a restraining means generally shown at 68 for transferring all of the reaction forces resulting from the reciprocating movement of the pistons 62 by the cam means 66 solely to the first housing portion 52. The restraining means 68 includes a spicket shaft means 70 which is connected to and extends from the first housing portion 52 and into a cavity or bore in the cylinder barrel 60. The spicket shaft 70 is coaxial or disposed on the axis of rotation of the cylinder barrel 60. The restraining means 68 also includes a connecting means generally shown at 72 interconnecting the spicket shaft 70 and the cylinder barrel 60. The cylinder barrel 60 is rotatably supported on the spicket shaft 70 and is also rotatably supported by the second portion 54 of the housing means at 74 as the cylinder barrel 60 includes a shaft portion 76 formed integrally therewith and extending exteriorly of the housing portion 54 and rotatably supported therein at 74. The shaft 76 is normally connected to a steering wheel in a marine craft for rotating the cylinder barrel 60 in either direction depending upon the desired direction of the marine craft.

The connecting means 72 includes a thrust bearing means 78 for transmitting the reaction forces from the cylinder barrel 60 to the spicket shaft 70. The spicket shaft 70 extends to a distal end 80 within the cylinder barrel 60 and the cylinder barrel 60 defines a cavity 82 adjacent the distal end 80 of the spicket shaft. The connecting means 72 also includes an axially extending bolt 84 threadedly engaging the distal end 80 of the spicket shaft 70 and the thrust bearing 78 is disposed upon and retained by the bolt 84.

The spicket shaft 70 includes valving passages, one of which is shown at 86, for successively communicating with fluid ports 88 during rotation of the cylinder barrel 60 for directing fluid to and from the piston cavities 64. The fluid ports 88 extend between each of the piston cavities 64 and the spicket shaft 70.

The cylinder barrel 60 includes a plurality of holes 90 and 90' which extend therethrough from the exterior thereof to the cavity 82 therein.

The connection means 68 further includes the projection means comprising the pins 92 which engage the thrust bearing 78 on the side thereof facing the distal end 80 of the spicket shaft 70. Each of the pins 92 is secured in one of the holes 90 by being press-fitted thereinto and engages the thrust bearing 78. Each of the holes 90 and 90' is axially aligned with one of the fluid ports 88 whereby the holes 90 and 90' may be machined or drilled and extended to drill or machine the fluid ports 88 thereby eliminating the requirement for plugs in the exterior wall of the cylinder barrel 60 extending from each piston cavity to the exterior surface of the cylinder barrel. In other words, each of the holes 90 and 90' is aligned with one of the fluid ports 88 didposed on the diametrically opposite side of the spicket shaft 70. Further, each of the holes 90 and 90' and the corresponding aligned fluid ports 88 are disposed on axes which are, in turn, disposed in an imaginary cone so that the axes of the holes and the fluid ports intersect the axis of rotation of the cylinder barrel 60 which is, in turn, the longitudinal axis of the spicket shaft 70.

In the embodiment shown, there are preferably six piston cavities 64 and, consequently, six pistons, thereby requiring six fluid ports 88. There are, therefore, six holes 90 and 90', however, half or three of the holes 90' are empty or absent of a pin 92 so as to define a vent passage from the cavity 82 in the cylinder barrel to the exterior of the cylinder barrel 60 to communicate with the reservoir of fluid surrounding the cylinder barrel 60 thereby preventing any fluid pressure build-up in the cavity 82. It will be appreciated that the pump assembly may include an odd number of pistons 62 in which case approximately one-half of the holes 90 and 90' will be either empty or include pins 92.

As illustrated, the second housing portion 54 is generally cup-shaped and surrounds the cylinder barrel 60 to define a fluid reservoir and the first housing portion 52 defines a closure or cap member for closing the cup-shaped housing portion 54. The first housing portion 52 has fluid passages therein in fluid communication with the valving passages 86 in the shaft 70 and in fluid communication with the fluid connections 94 and 96 which may have threaded connections for connection to fluid lines extending to an actuator, or the like. The shaft 70 has passages similar to the passages 36 and 38 as in the shaft 26. A filler cap 98 threadedly engages the cup-shaped housing portion 54 and may be removed for filling the reservoir defined by the housing portion 54 with hydraulic fluid.

It will be noted that the holes 90 and 90' are disposed to provide an axial clearance space between the pins 92 and the distal end of the spicket shaft 70. When the pump assembly is assembled, the bolt 84 is secured to the spicket shaft 70, as shown, with the thrust bearing 78 in position. Thereafter, the spicket shaft 70 is inserted into cylinder barrel 60 and forwardly sufficiently that the pins 92 may be driven into the holes 90 and clear the thrust bearing 78 because of the clearance provided between the thrust bearing 78 and the distal end of the spicket shaft 70. Once the pins 92 are in position, the spicket shaft 70 is bolted or otherwise tightened to the closure housing portion 52 and drawn rearwardly thereagainst so that the thrust bearing 78 is urged against the pins 92. Since the pins define a cone or disk-shaped surface, the thrust bearing 78 bears against the pins forming a dish to arrange or align itself to a natural position perpendicular to the axis of rotation. In other words, the disposition of the pins 92 are such as to provide a self-aligning function of the thrust bearing 79 during assembly.

As will be appreciated, during rotation of the cylinder barrel 60, the pistons 62 are reciprocated and the resultant forces created by the pressure in the piston cavities 64 and transferred to the cylinder barrel 60 are, in turn, transmitted through the pins 92 to the thrust bearing 78 and then to the spicket shaft 70 and to the housing portion 52. This eliminates any transmission of the reaction forces to the cup-shaped housing portions 54 and, therefore, the cup-shaped housing portion 54 may be made of nonstructural materials or low cost materials such as plastic, or the like.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. An axial piston pump assembly comprising; housing means including first and second interconnected housing portions, a cylinder barrel rotatably supported in said housing means, said cylinder barrel including a drive shaft extending therefrom and through and exteriorly of said second housing portion, a plurality of pistons reciprocatively supported in a plurality of piston cavities in said cylinder barrel for reciprocating movement parallel to an axis of rotation, cam means disposed between said pistons and said first housing portion for reacting with said pistons for causing said reciprocating movement thereof upon rotation of said cylinder barrel, shaft means extending from said first housing portion and into said cylinder barrel to a distal end for rotatably supporting said cylinder barrel, said cylinder barrel including fluid ports extending between each of said piston cavities and said shaft means, said shaft means including valving passages for successively communicating with said fluid ports during rotation of said cylinder barrel for directing fluid to and from said piston cavities, connecting means interconnecting said cylinder barrel and said distal end of said shaft means for transferring reaction forces resulting from said reciprocating movement of said pistons by said cam means through said shaft means to said first housing portion while freely allowing rotation of said cylinder barrel on said shaft means, said shaft means extending into said cylinder barrel to a distal end thereof, said cylinder barrel defining a cavity adjacent said distal end of said shaft means, said cylinder barrel including a plurality of holes extending therethrough from the exterior thereof to said cavity therein, said connecting means including a thrust bearing supported at said distal end of said shaft means and a plurality of pins secured in at least some of said holes and engaging said thrust bearing on the side thereof facing said distal end of said shaft means.

2. An assembly as set forth in claim 1 wherein each of said holes is aligned with one of said fluid ports.

3. An assembly as set forth in claim 1 wherein each of said holes is aligned with one of said fluid ports disposed on the diametrically opposite side of said shaft means.

4. An assembly as set forth in claim 3 wherein said holes and said fluid ports are disposed on axes disposed in an imaginary cone.

5. An assembly as set forth in claim 4 wherein said axes of said holes and said fluid ports intersect said axis of rotation.

6. An assembly as set forth in claim 5 wherein at least one of said holes is empty and defines a vent passage from said cavity to the exterior of said cylinder barrel.

7. An assembly as set forth in claim 4 wherein approximately one-half of said holes have said pins disposed therein and the remaining number of said holes are empty and define vent passages.

8. An assembly as set forth in claim 5 wherein said connecting means includes an axially extending bolt threadedly engaging said distal end of said shaft means, said thrust bearing being disposed on said bolt.

9. An assembly as set forth in claim 8 wherein each of said pins is press-fitted into one of said holes.

10. An assembly as set forth in claim 9 wherein said second housing portion is made of plastic material.

11. An assembly as set forth in claim 9 wherein said holes and pins are disposed to provide an axial clearance space between said pins and said distal end of said shaft means.

12. An assembly as set forth in claim 11 wherein said first housing portion comprises a cover member connected to said shaft means and including passages therein communicating with said valving passages in said shaft means and inlet and outlet connections.

* * * * *